US008894444B2

(12) United States Patent
Funahashi

(10) Patent No.: US 8,894,444 B2
(45) Date of Patent: Nov. 25, 2014

(54) COAXIAL ELECTRICAL CONNECTOR AND COAXIAL ELECTRICAL CONNECTOR ASSEMBLY INCLUDING A TUBULAR CONTACT FOR REDUCING THE HEIGHT AND IMPROVING THE RETENTION STRENGTH AGAINST MATING OR REMOVAL

(75) Inventor: Akio Funahashi, Machida (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 29 days.

(21) Appl. No.: 13/541,332

(22) Filed: Jul. 3, 2012

(65) Prior Publication Data

US 2013/0171876 A1 Jul. 4, 2013

(30) Foreign Application Priority Data

Jul. 26, 2011 (JP) ..... 2011-163295

(51) Int. Cl.
*H01R 13/66* (2006.01)
*H01R 24/50* (2011.01)
*H01R 103/00* (2006.01)

(52) U.S. Cl.
CPC ..... *H01R 24/50* (2013.01); *H01R 2103/00* (2013.01)
USPC ..... 439/620.03

(58) Field of Classification Search
USPC ..... 439/248, 260, 374, 620.03
See application file for complete search history.

(56) References Cited

U.S. PATENT DOCUMENTS

| | | | | |
|---|---|---|---|---|
| 3,193,617 | A * | 7/1965 | Deakin | 174/153 R |
| 3,193,647 | A | 7/1965 | Beaudoin et al. | |
| 6,146,184 | A * | 11/2000 | Wilson et al. | 439/374 |
| 6,174,185 | B1 * | 1/2001 | Cecil, Jr. | 439/248 |
| 6,196,856 | B1 * | 3/2001 | De Villeroche | 439/248 |
| 6,322,382 | B1 * | 11/2001 | Viallet | 439/248 |
| 7,341,470 | B2 * | 3/2008 | Suzuki et al. | 439/260 |
| 7,503,773 | B2 * | 3/2009 | Tokunaga | 439/74 |
| 8,203,159 | B2 * | 6/2012 | Zhong et al. | 257/95 |

FOREIGN PATENT DOCUMENTS

| | | |
|---|---|---|
| CN | 2599815 Y | 1/2004 |
| JP | 3-119976 | 12/1991 |
| JP | 2002-42985 | 2/2002 |

* cited by examiner

*Primary Examiner* — Chandrika Prasad
(74) *Attorney, Agent, or Firm* — Oblon, Spivak, McClelland, Maier & Neustadt, L.L.P.

(57) ABSTRACT

A coaxial electrical connector having a shorter height and improved retention strength against mating and removal with a simple structure is provided. A connector mounting portion P1 is formed as a recess or a through hole in a printed wiring board P, and the connector is mounted such that its insulating housing 11 is inserted into this connector mounting portion P1 of the printed wiring board P, so that the height of the connector is reduced. Load applied when a counterpart electrical connector 20 is mated with or removed from the connector is stably supported by the insulating housing 11 via a connector holding portion 11*c*, so that components such as conductive contacts are prevented from deformation, and solder joints are prevented from peeling.

12 Claims, 9 Drawing Sheets

COAXIAL ELECTRICAL CONNECTOR AND COAXIAL ELECTRICAL CONNECTOR ASSEMBLY INCLUDING A TUBULAR CONTACT FOR REDUCING THE HEIGHT AND IMPROVING THE RETENTION STRENGTH AGAINST MATING OR REMOVAL

BACKGROUND OF THE INVENTION

1. Field of the Invention

The present invention relates to a coaxial electrical connector configured to allow for mating and separation of two connector parts such that their tubular contacts make contact with and separate from each other, and a coaxial electrical connector assembly.

2. Description of the Related Art

Commonly, electrical connectors electrically connecting various signal transmission media such as coaxial cables are widely used in various electrical devices and the like. A coaxial electrical connector shown in FIG. 10, for example, includes a receptacle connector 1 used as mounted on a printed wiring board P, and a plug connector 2 having a terminal portion of a coaxial cable as a signal transmission medium (see reference symbol SC in FIG. 1 illustrating the present invention) coupled thereto, this plug connector being configured to mate with and be removed from the former in an up and down direction of the drawing. The receptacle connector 1 includes a plate-like insulating housing 1*a*, with a center contact 1*b* for signal transmission and an outer contact 1*c* for connection to ground attached to the housing substantially concentrically. The plug connector 2 configured as the coupling counterpart includes a center contact 2*b* for signal transmission and an outer contact 2*c* for connection to ground attached substantially concentrically, inside and outside an insulating housing 2*a* thereof. When the plug connector 2 is inserted from above downward onto this receptacle connector 1, the center contacts 1*b* and 2*b*, and the outer contacts 1*c* and 2*c*, contact each other such as to overlap each other radially inside and outside for establishing electrical connection.

With the trend to reduce the size and thickness of electronic devices in recent years, the demand for reducing the size, in particular the height, of coaxial electrical connectors, is increasing. In the patent literature listed below, for example, a configuration is adopted where a coaxial electrical connector is dropped in or inserted in a connector mounting portion formed as a recess or through hole in a printed wiring board, thereby to reduce the mounting height of the coaxial electrical connector.

In these prior art coaxial electrical connectors, however, retaining of the connector on the printed wiring board is achieved by the solder joint strength between terminals such as conductive contacts and the printed wiring board. Therefore, the terminals such as conductive contacts or solder joints may be subjected to a concentrated load when the counterpart electrical connector (plug connector) is mated with or removed from the connector, because of which components such as conductive contacts may be deformed, or solder joints may be peeled off.

We disclose information to be material of prior art to patentability as follows.

Patent Literature 1: Japanese Unexamined Utility Model Publication No. 03-119976

Patent Literature 2: Japanese Unexamined Patent Publication No. 2002-42985

SUMMARY OF THE INVENTION

Accordingly, an object of the present invention is to provide a coaxial electrical connector having a shorter height and improved retention strength against mating or removal with a simple structure.

To achieve the above object, a coaxial electrical connector or an assembly thereof according to the present invention is used as mounted on a printed wiring board, and configured with a tubular contact attached to an insulating housing to contact a tubular contact provided in another connector as a coupling counterpart for establishing electrical connection. The insulating housing has a shape adapted to be inserted into a connector mounting portion formed as a recess or a through hole in the printed wiring board, and the insulating housing includes a connector holding portion to be abutted on a surface of the printed wiring board in which the connector mounting portion is opened when the insulating housing is inserted into the connector mounting portion.

According to the present invention having such a configuration, since the insulating housing is inserted into the connector mounting portion formed as a recess or a through hole in the printed wiring board, the connector, when mounted, has a shorter height. Also, the connector has a support structure with a connector holding portion abutting on the surface of the printed wiring board when the connector is completely mounted, so that the load applied when the counterpart electrical connector (plug connector) is mated therewith or removed therefrom is stably received by the insulating housing via the connector holding portion, whereby components such as conductive contacts are prevented from deformation, and the solder joints are prevented from peeling.

In the present invention, the connector holding portion should preferably protrude from a body of the insulating housing in a flange shape.

According to the present invention having such a configuration, the connector holding portion of the insulating housing can be formed easily.

In the present invention, the connector is preferably configured such that the counterpart connector is inserted into an inner region of the tubular contact.

According to the present invention having such a configuration, as the counterpart electrical connector (plug connector) is mated with or removed from the connector in the inner region of the tubular contact, the overall size of the connector is reduced.

As described above, the coaxial electrical connector or an assembly thereof according to the present invention has a connector mounting portion formed as a recess or a through hole in a printed wiring board, and the connector is mounted such that its insulating housing is inserted into this connector mounting portion of the printed wiring board, so that the height of the connector is reduced. Load applied when the counterpart electrical connector is mated with or removed from the connector is stably supported by the insulating housing via the connector holding portion, so that components such as conductive contacts are prevented from deformation, and solder joints are prevented from peeling. Thus the height is reduced while the retention strength against mating or removal is improved with a simple structure, whereby reliability of the coaxial electrical connector or the assembly thereof can be significantly improved at low cost.

DESCRIPTION OF THE PREFERRED EMBODIMENTS

Figure 1:
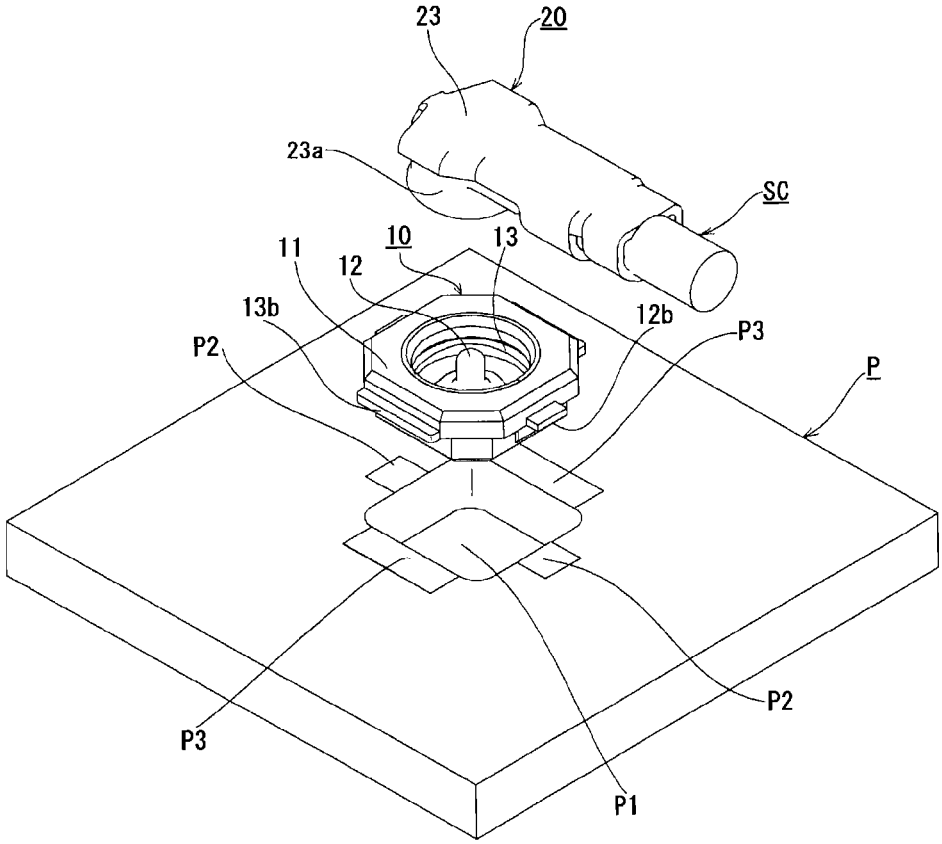
FIG. 1 is an external perspective illustration of a coaxial electrical connector assembly according to one embodiment of the present invention, illustrating the entire structure in a separated state.
Figure 2:
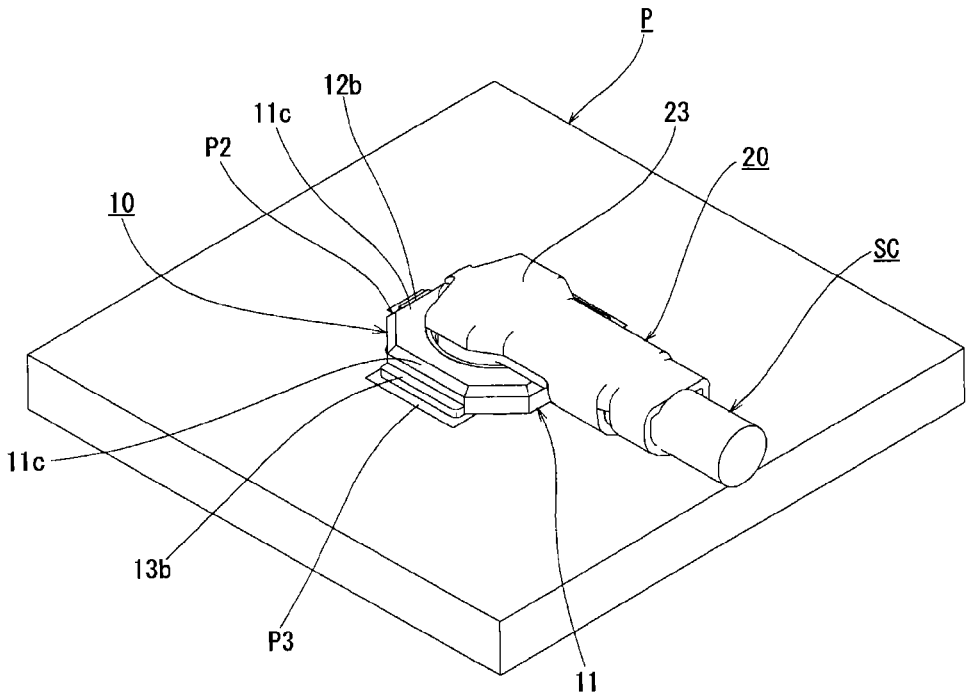
FIG. 2 is an external perspective illustration of the coaxial electrical connector assembly shown in FIG. 1, illustrating the entire structure in a mated state.
Figure 3:
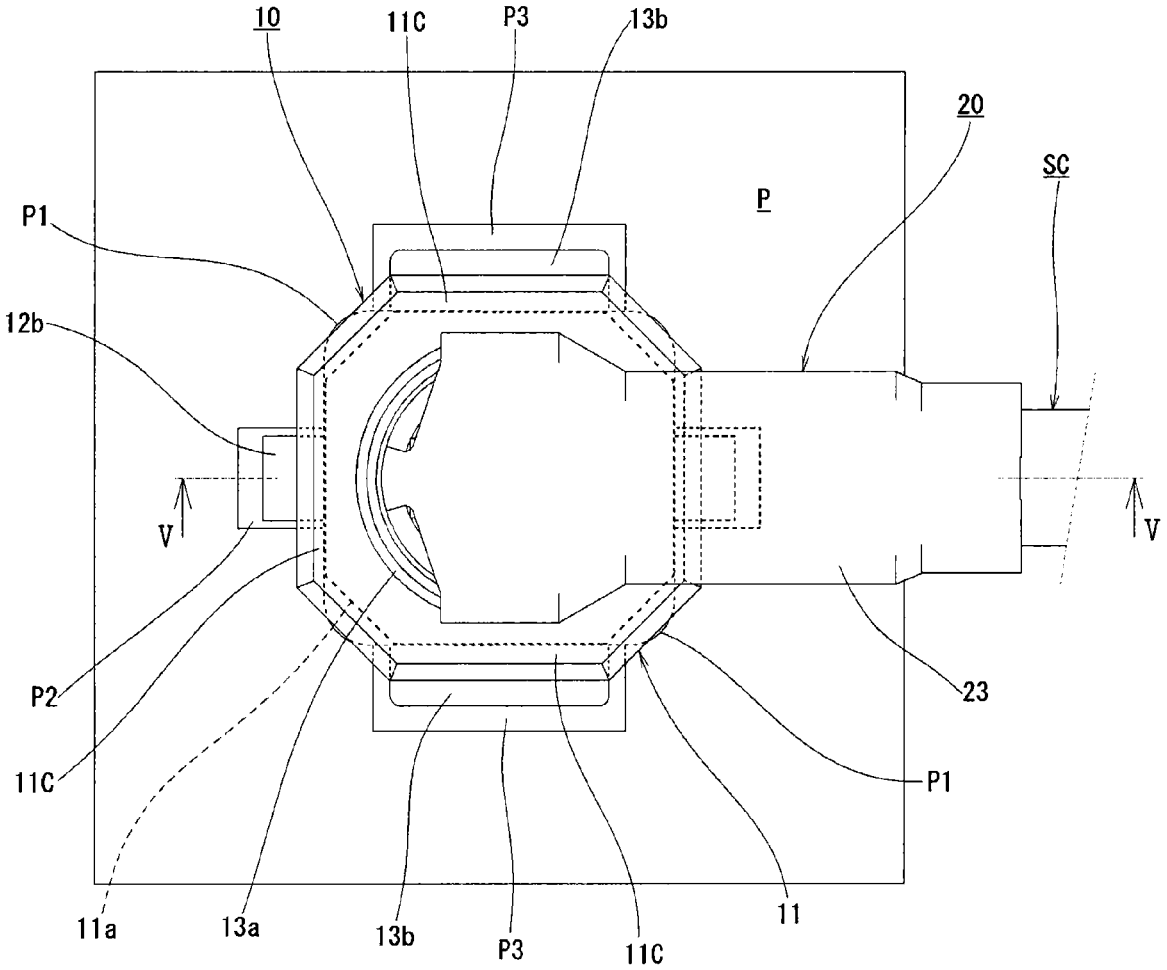
FIG. 3 is a plan illustration of the coaxial electrical connector assembly shown in FIG. 1 and FIG. 2, illustrating the entire structure.
Figure 4:
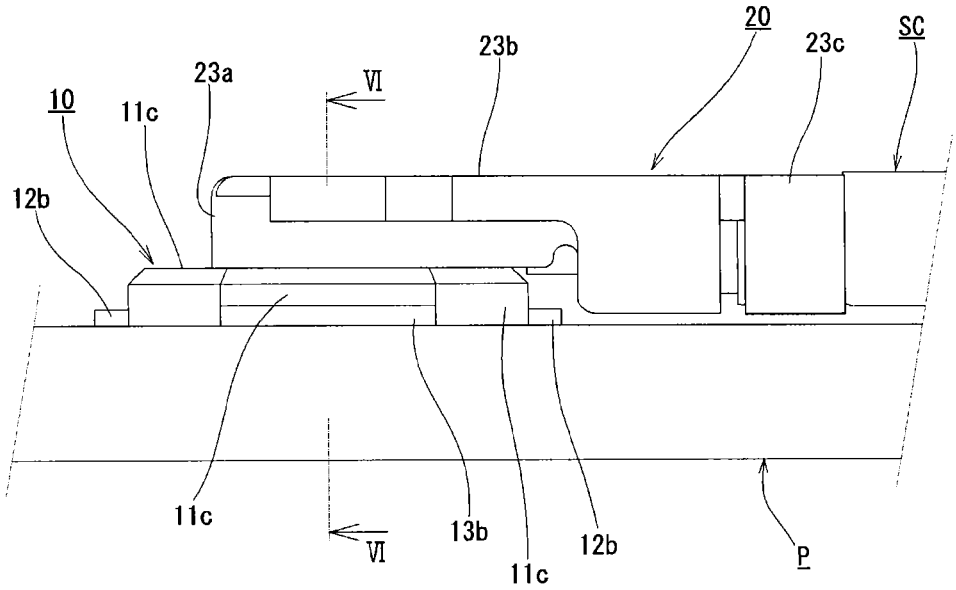
FIG. 4 is a side illustration of the coaxial electrical connector assembly shown in FIG. 3, illustrating the entire structure.

Hereinafter, embodiments of the present invention will be described in detail with reference to the drawings.

[Connector Assembly]

First, the coaxial electrical connector assembly according to one embodiment of the present invention shown in FIG. 1 to FIG. 9 is formed by a printed wiring board P formed with an electronic circuit as required, a vertical mating type receptacle connector 10 mounted on this printed wiring board P, and a plug connector 20 as the other counterpart connector. The plug connector 20 is mated with, from above, or removed from, the receptacle connector 10 on the printed wiring board P. Hereinafter, the mating direction in which the plug connector 20 is inserted into the receptacle connector 10 will be referred to as "downward direction", and contrary, the removing direction in which it is pulled out will be referred to as "upward direction".

[Printed Wiring Board]

A connector mounting hole P1 adapted to receive the receptacle connector 10 is formed at a predetermined position in the printed wiring board P on which the receptacle connector 10 is mounted. This connector mounting hole P1 is formed as a through hole that is substantially quadrate in plan view and extends through the printed wiring board P in the up and down direction, and positioned such that terminal portions of conductive paths formed on the upper surface of the printed wiring board P reach the open edges of this connector mounting hole P1.

These terminal portions of conductive paths formed on the upper surface of the printed wiring board P include a pair of signal connection terminals P2, P2 and a pair of ground connection terminals P3, P3. The pair of signal connection terminals P2, P2 are arranged opposite each other on both sides of the upper end opening of the connector mounting hole P1, while the pair of ground connection terminals P3, P3 are arranged opposite each other on both sides of the connector mounting hole P1 in a direction orthogonal to the opposing direction of the pair of signal connection terminals P2, P2.

[Receptacle Connector]

The receptacle connector 10 forming one component of such a coaxial electrical connector assembly includes an insulating housing (dielectric member) 11 which is a hollow tubular member. A center contact (signal contact) 12 formed as a hollow cylindrical contact and an outer contact (ground contact) 13 are securely formed in a concentric manner by insertion molding in the inner region of this hollow tubular insulating housing 11.

[Insulating Housing]

The insulating housing 11 of this receptacle connector 10 has a housing body 11*a* which is a cup-shaped member with a bottom. This housing body 11*a* is formed to have an outer circumferential shape that is generally quadrate in plan view and slightly smaller than the connector mounting hole P1, so that it can be inserted inside the connector mounting hole P1. The housing body 11*a* has a bottom plate 11*b* at the lower end, and its upper end is formed as a circular opening. The housing body 11*a* is inserted into the connector mounting hole P1 from the bottom plate 11*b*, so that, when it is completely inserted in the connector mounting hole P1, the upper end opening of the housing body 11*a* opens upward.

A connector holding portion 11*c* is integrally provided to an outer circumferential portion of the upper end opening of the insulating housing 11, such as to protrude radially outward from the housing body 11*a* in a flange shape. This connector holding portion 11*c* is formed in a generally octagonal shape in plan view, and formed to extend outward farther than the upper end opening of the connector mounting hole P1. The connector holding portion is configured to abut on the upper surface of the printed wiring board P, i.e., the surface defining the upper end opening of the connector mounting hole P1, from above, when the insulating housing 11 is inserted inside the connector mounting hole P1 as mentioned above.

[Contact]

On the other hand, the center contact (signal contact) 12 and the outer contact (ground contact) 13 are used for transmission of signals and for connection with ground, respectively, and they include respective mating contacts 12*a*, 13*a* adapted to contact the plug connector 20 as the coupling counterpart and solder terminals 12*b* and 13*b* extending radially outward from the mating contacts 12*a*, 13*a*.

The mating contacts 12*a*, 13*a* are formed upright from a central and an outer circumferential portion of the bottom plate 11*b* of the housing body 11*a*, these mating contacts 12*a*, 13*a* being disposed concentrically in the inner region of the housing body 11*a*. The mating contact 12*a* forming part of the center contact (signal contact) 12 is formed from a hollow conductive pin-like member having a generally circular horizontal cross-sectional shape. The mating contact 13*a* that is tubular and forms part of the outer contact (ground contact) 13 is disposed to surround the mating contact 12*a* of the center contact 12 concentrically and to fit along the inner circumferential wall of the housing body 11*a*. These mating contacts 12*a*, 13*a* of the center contact 12 and outer contact 13 are each to be mated with and removed from corresponding portions of the plug connector 20 that is the coupling counterpart to be described later.

The solder terminals 12*b* of the center contact (signal contact) 12 are formed as two plate-like members extending generally horizontally from the mating contact 12*a* along the bottom plate 11*b* of the insulating housing 11, these solder terminals 12*b*, 12*b* extending in radially opposite directions from the mating contact 12*a* as the center. The extending distal ends of these solder terminals 12*b* are bent upwards generally at right angles to stand up along the outer circumferential wall of the insulating housing 11, bent generally at right angles at the standing upper ends and protruding radially outward generally horizontally. The outer end portions in the radial direction of these solder terminals 12*b* are set from above on the signal connection terminals P2 on the printed wiring board P and joined thereto by soldering.

Meanwhile, the mating contact 13*a* forming part of the outer contact (ground contact) 13 is a generally hollow tubular member and disposed so that the inner circumferential wall of the mating contact 13*a*, which runs along the inner circumferential wall of the housing body 11*a*, is exposed toward the center.

The solder terminals 13*b* are continuously formed in pair to the lower end edge of the mating contact 13*a* at radially opposite positions. The pair of solder terminals 13*b*, 13*b* are arranged to face opposite each other in a direction generally orthogonal to the direction of a line connecting the solder terminals 12*b*, 12*b* of the center contact (signal contact) 12. More specifically, the solder terminals extend downward from the lower end edge of the mating contact 13*a* and turn immediately back upward, standing up and exposed from the outer circumferential wall of the insulating housing 11 to the outside, and are bent generally at right angles at the standing upper ends to protrude radially outward generally horizontally. The outer end portions in the radial direction of these solder terminals 13*b* are set from above on the ground connection terminals P3 on the printed wiring board P and joined thereto by soldering.

[Plug Connector]

The plug connector 20, on the other hand, which forms the other connector component or coupling counterpart of the coaxial electrical connector assembly according to this embodiment, is formed as a vertical mating connector mated from above with the receptacle connector 10 as mentioned above. A terminal portion of a small coaxial connector SC as a signal transmission medium is coupled to the insulating housing 21 of this plug connector 20. Hereinafter, the end edge of this plug connector 20 where the small coaxial cable SC is coupled will be referred to as "rear end edge", the end edge on the opposite side will be referred to as "front end edge", and directions toward these rear end edge and front end edge will be referred to as "rearward" and "frontward", respectively.

The insulating housing (dielectric member) 21 of the plug connector 20 has a generally tubular, downwardly protruding body insertion guide 21*a*. In an upper end portion of the insulating housing 21 is disposed a center contact (signal contact) 22 for signal transmission. A conductive shell 23 made of a thin metal plate member is attached to the outer surface of the insulating housing 21.

This conductive shell 23 includes an outer contact 23*a* as a shell body, which is a hollow tubular contact member radially enclosing the body insertion guide 21*a* of the insulating housing 21 from outside. Above this outer contact 23*a* is integrally and continuously formed a shell cover 23*b* covering the upper end opening of the outer contact 23*a* and the insulating housing 21 from above.

The outer contact 23*a* forming the shell body of the conductive shell 23 is formed from a tubular member having a smaller diameter than the outer contact 13 of the receptacle connector 10, so that it fits inside the outer contact 13 when the connector is mated with the receptacle connector 10. Namely, the lower end opening of the outer contact (tubular contact) 23*a* of the plug connector 20 is configured to overlap radially inside the upper end opening of the outer contact (tubular contact) 13 of the receptacle connector 10 generally concentrically when inserted. When both connectors 10, 20 are mated with each other, the outer contact 23*a* of the plug connector 20 slides down along the inner circumferential surface of the outer contact 13 of the receptacle connector 10, and when locking portions engage with each other, both connectors 10, 20 are mated with each other generally concentrically, with the outer contact 23*a* of the plug connector 20 being located radially inside, and the outer contact 13 of the receptacle connector 10 being located radially outside.

On the other hand, the shell cover 23*b* forming part of the conductive shell 23 of the plug connector 20 is configured to cover the upper end opening of the outer contact 23*a* from above. At the rear end of this shell cover 23*b* is provided a cable support 23*c* having a semicircular longitudinal cross-sectional shape to protrude rearward generally horizontally, this cable support 23*c* holding the terminal portion of the small coaxial cable SC.

At the terminal portion of the small coaxial cable SC as the signal transmission medium, a center conductor SCa (signal wire) and an outer conductor (shielding wire) SCb of the cable coaxial with the former are exposed, with the outer coating stripped off. The center conductor SCa of the cable disposed along the center axis of the small coaxial cable SC is connected to the center contact (signal contact) 22 attached to the insulating housing 21 to form a signal circuit. The outer conductor SCb of the cable disposed such as to surround the outer circumference of the cable center conductor SCa is held such as to contact the shell cover 23*b* of the conductive shell 23 so as to form a ground circuit, as this shell cover 23*b* is continuous with the outer contact 23*a*.

In an initial state before the terminal portion of the small coaxial cable SC is coupled and fixed in position, the shell cover 23*b* of the conductive shell 23 is open upward. Namely, the shell cover 23*b* in this initial state is disposed upright substantially vertically upward via a thin strip of connecting member on the opposite side from the cable support 23*c*, i.e., at the front end portion of the outer contact 23*a* as the shell body. Inside the shell cover 23*b*, an insulating pressure plate 21*b* standing upward from the body insertion guide 21*a* of the insulating housing 21 is disposed to extend along the inner surface of the shell cover 23*b*.

In the initial open state of the conductive shell 23, the small coaxial cable SC is set so that its terminal portion sits on the cable support 23*c*, after which the shell cover 23*b* is turned and pushed down to be substantially horizontal, so that the connecting member is bent generally at right angles with the insulating pressure plate 21*b*. Thereby, the upper end openings of the body insertion guide 21*a* of the insulating housing 21 and the outer contact 23*a* of the conductive shell 23 are covered from above by the shell cover 23*b*, so that the insulating housing 21 and the conductive shell 23 are closed. The cable support 23*c* of the shell cover 23*b* is configured to cover the small coaxial cable SC from the top over the outer portions, and plate-like parts on both sides of this shell cover 23*b* are bent inwards or clinched to be fastened, with the cable outer conductor SCb contacting the cable support 23*c*, so that the ground circuit is formed with the conductive shell 23.

Figure 5:
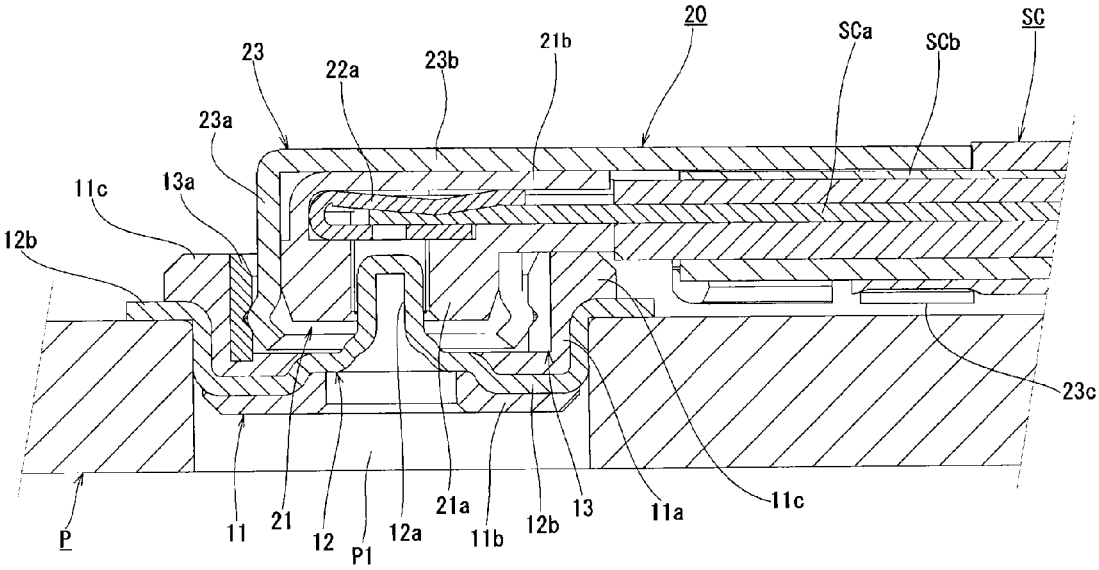
FIG. 5 is a longitudinal cross-sectional illustration along the line V-V in FIG. 3.
Figure 6:
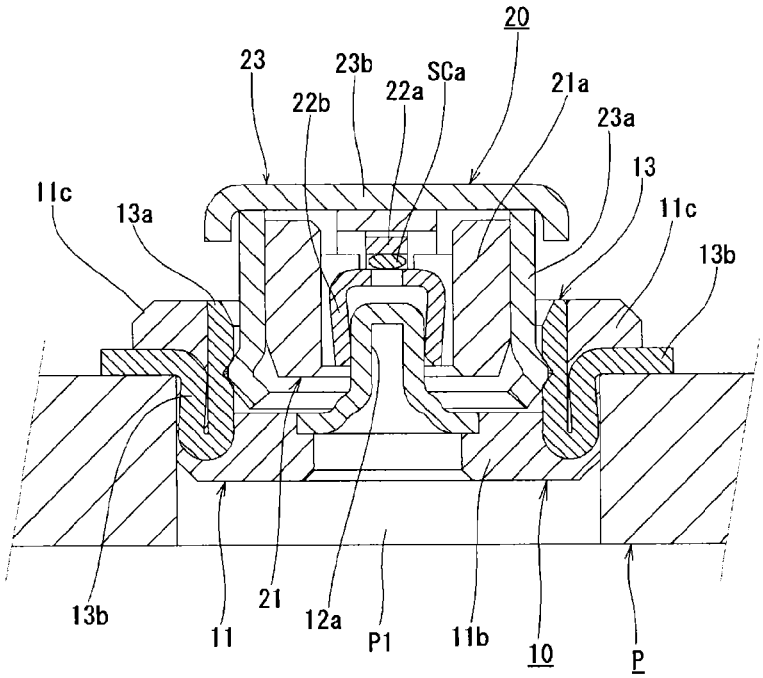
FIG. 6 is a longitudinal cross-sectional illustration along the line VI-VI in FIG. 4.
Figure 7:
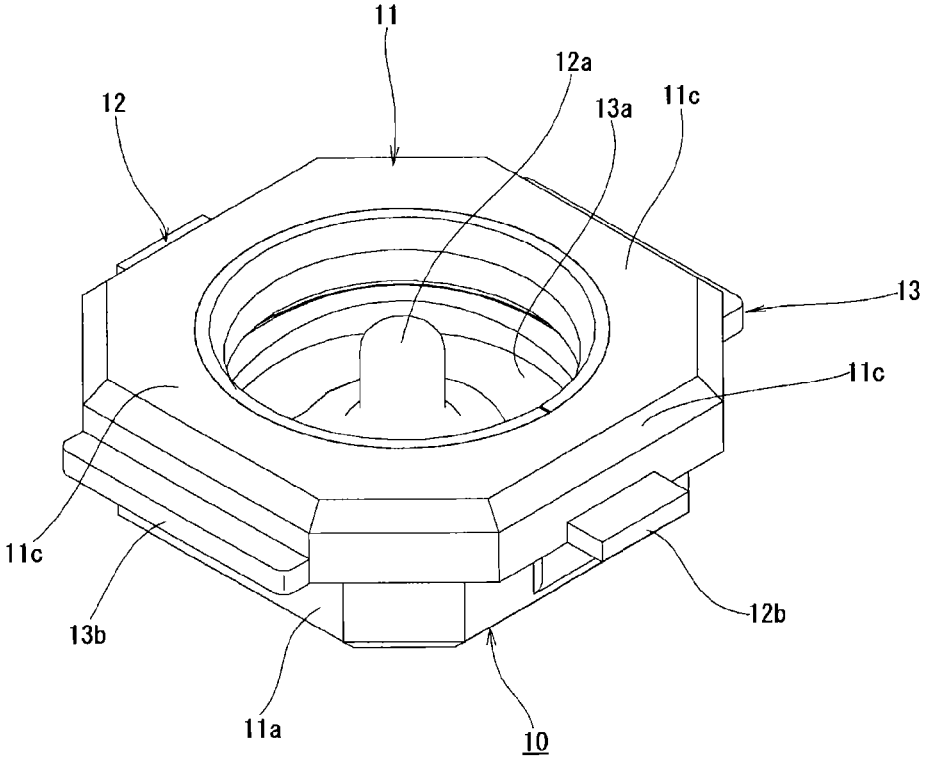
FIG. 7 is an external perspective illustration of a receptacle connector forming the coaxial electrical connector assembly shown in FIG. 1 to FIG. 6, illustrating the structure of the receptacle connector alone from above.
Figure 8:
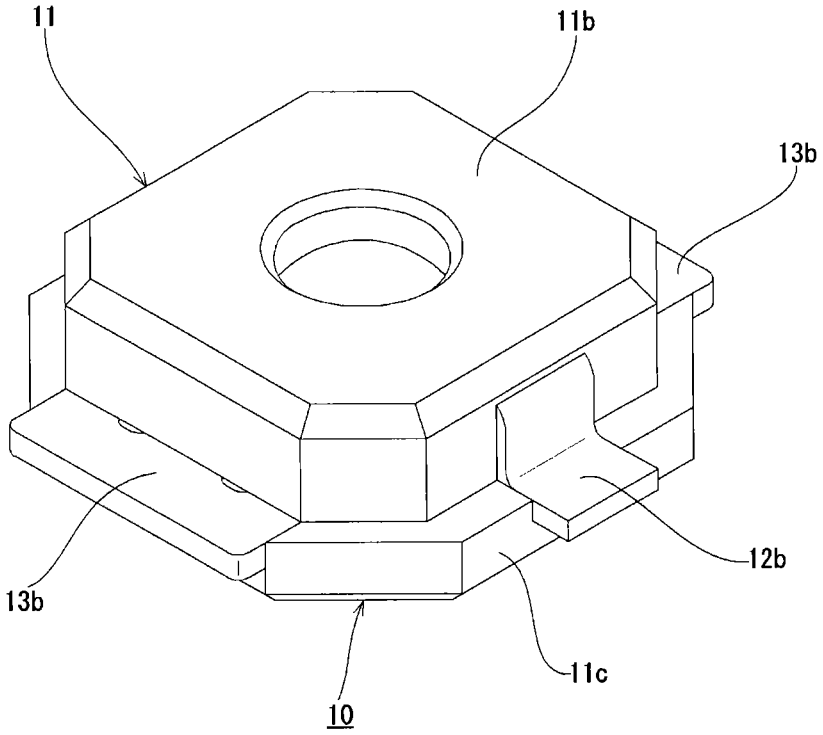
FIG. 8 is an external perspective illustration of a receptacle connector forming the coaxial electrical connector assembly shown in FIG. 1 to FIG. 6, illustrating the structure of the receptacle connector alone from below.
Figure 9:
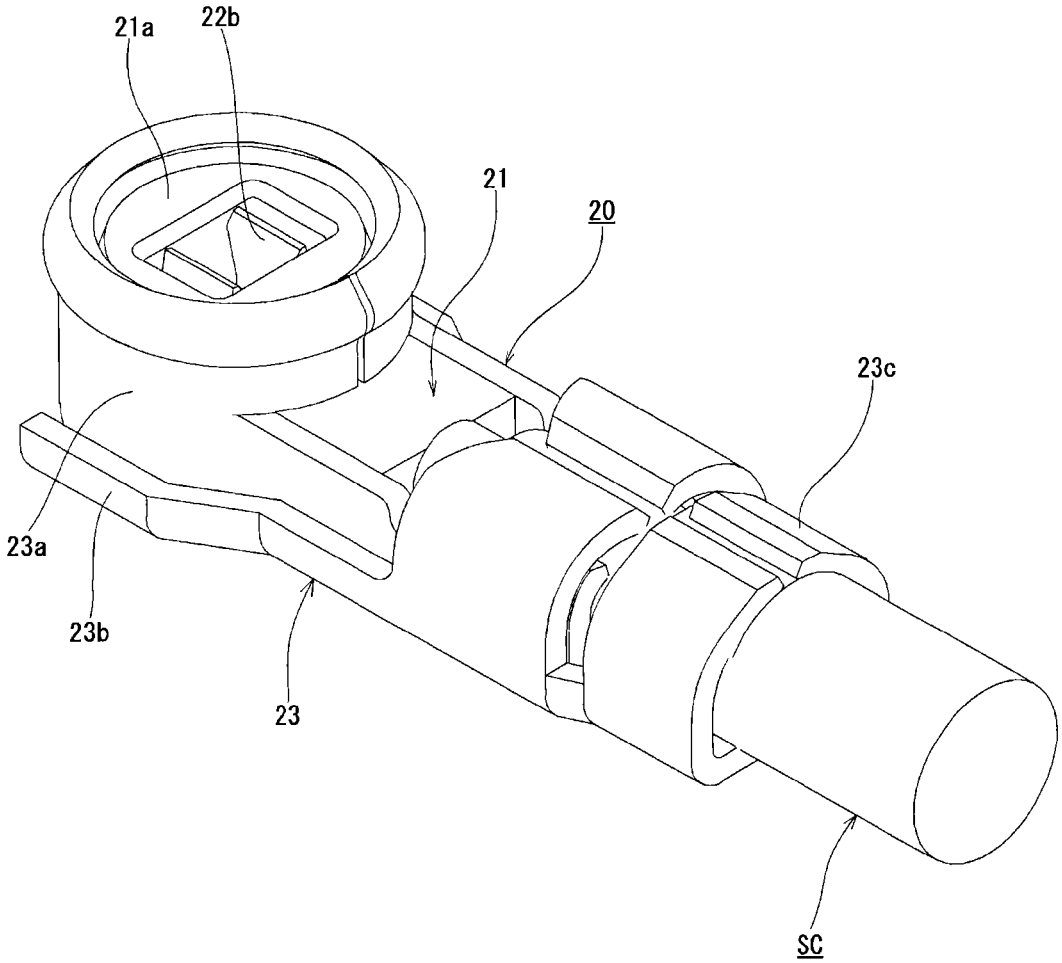
FIG. 9 is an external perspective illustration of a plug connector forming the coaxial electrical connector assembly shown in FIG. 1 to FIG. 6, illustrating the structure of the plug connector alone from below.
Figure 10:
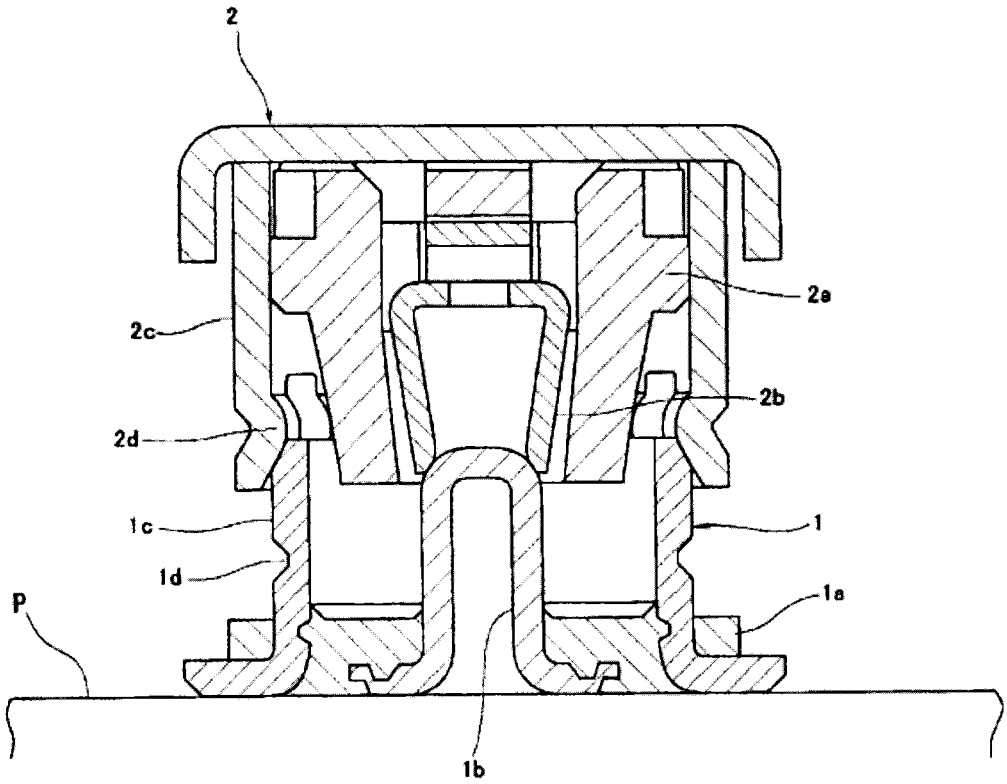
Fig.10 Prior Art
FIG. 10 is a cross-sectional illustration of a conventional coaxial electrical connector assembly, illustrating a plug connector and a receptacle connector in the process of mating in a cross section cut in a direction orthogonal to the axial direction of the coaxial cable.

The center contact (signal contact) 22 in the plug connector 20 is attached to the body insertion guide 21*a* of the insulating housing 21 by press-fitting or insertion molding or the like, and includes, as shown particularly in FIG. 5, a cable clip portion 22*a* connected to the cable center conductor (signal wire) SCa of the small coaxial cable SC, and a contact portion

22*b* extending downward from this cable clip portion 22*a* to contact the center contact 12 of the receptacle connector 10 as mentioned above.

The cable clip portion 22*a* has a clip beam structure, bent substantially in the shape of "U" lying on its side as viewed in side view so as to clip the cable center conductor (signal wire) SCa of the small coaxial cable SC from above and below. The upper beam part forming this cable clip portion 22*a* is formed midway with a downward protrusion for pressing the cable center conductor (signal wire) SCa from above.

In the initial state before the terminal portion of the small coaxial cable SC is coupled, the upper beam part of the cable clip portion 22*a* is also open upward. Namely, in the initial open state, the upper beam part of the cable clip portion 22*a* stands diagonally upward, and, after the small coaxial cable SC is set so that the terminal portion sits on the cable support 23*c*, when the shell cover 23*b* of the conductive shell 23 is pushed down with the insulating pressure plate 21*b* to be substantially horizontal, the upper beam part of the cable clip portion 22*a* is also pushed down to be substantially horizontal, to press down the cable center conductor (signal wire) SCa from above.

The contact portion 22*b* of the center contact (signal contact) 22 is formed as a hollow member press-fitted over the center contact (signal contact) 12 of the receptacle connector 10 from outside, extending downward from the cable clip portion 22*a* in a cantilevered manner and having a substantially inverted U-shape cross section, inside the body insertion guide 21*a* of the insulating housing 21, so that the contact portion 22*b* makes pressure contact with the center contact 12 of the receptacle connector 10 by resilient displacement thereof.

According to the embodiment having such a configuration, since the insulating housing 11 of the receptacle connector 10 is inserted into the connector mounting hole (through hole) P1 formed in the printed wiring board P to mount the receptacle connector 10, the connector's height is reduced.

On the other hand, the receptacle connector 10 is configured with a support structure so that, when it is completely mounted, its connector holding portion 11*c* abuts on the upper surface of the printed wiring board P from above, i.e., the surface in which the upper end opening of the connector mounting hole P1 is defined. Therefore, the load applied when the coupling counterpart, the plug connector 20, is mated therewith or removed therefrom is stably received by the insulating housing 11 via the connector holding portion 11*c*, so that components such as the center contact (signal contact) 12 or outer contact (ground contact) 13 are prevented from deformation, and the solder terminals 12*b* and 13*b* are prevented from peeling.

In this embodiment, in particular, as the connector holding portion 11*c* of the insulating housing 11 protrudes from the housing body 11*a* in a flange shape, it can be formed easily.

Also, in this embodiment, the plug connector 20 as the coupling counterpart is mated with or removed from the inner region of the receptacle connector 10, so that the overall size of the connector is reduced.

While the invention made by the present inventor has been described in specific terms based on the embodiments, it should be understood that the embodiment is not limited to those described above and can be variously modified without departing from the scope of its subject matter.

For example, while the connector mounting hole in the embodiment described above is formed to have a substantially quadrate shape in plan view, it may be formed circular or in other shapes. The connector mounting hole may be formed as a recess with a closed bottom, instead of a through hole as in this embodiment described above. In this case, there is an advantage that control of the depth of the recess required in the conventional technique is no longer necessary.

While the connector holding portion is formed in a flange shape in the embodiment described above, other mechanical fastening means may be configured as required.

Furthermore, while the present invention is applied to a vertical mating type electrical connector in the embodiment described above, the invention may be applied similarly to electrical connectors of horizontal mating type.

The present invention is not limited to a single small coaxial cable connector as in the embodiment described above, and may be applied similarly to small coaxial cable connectors having a multipole configuration, electrical connectors with a combination of small coaxial cables and insulation cables, or electrical connectors for receiving flexible wiring boards, or the like.

As described above, this embodiment can be widely applied to a variety of coaxial electrical connectors used in various electrical devices.

What is claimed is:

1. A coaxial electrical connector mounted on a printed wiring board having a signal connection terminal and a ground connection terminal formed as conductive paths on the printed wiring board, comprising:

an insulating housing; and a tubular contact attached to the insulating housing to contact a tubular contact provided in another connector as a coupling counterpart for establishing electrical connection, wherein the insulating housing is shaped to be inserted into a connector mounting portion formed as a recess or a through hole in the printed wiring board, wherein the insulating housing includes a connector holding portion to be abutted on a surface of the printed wiring board when the insulating housing is inserted into the connector mounting portion, and wherein the connector holding portion protrudes from a body of the insulating housing in a flange shape.

2. The coaxial electrical connector according to claim 1, wherein said another connector as the coupling counterpart is inserted in an inner region of the tubular contact.

3. A coaxial electrical connector assembly, comprising a printed wiring board formed with the connector mounting portion, and the coaxial electrical connector according to one of claims 1 or 2.

4. The coaxial electrical connector according to claim 1, wherein the tubular contact includes a center contact and an outer contact which are fixed in a concentric manner in an inner region of the insulating housing, the center contact and the outer contact each including respective mating contacts to connect to the another connector with solder terminals extending radially outward from the mating contacts.

5. The coaxial electrical connector according to claim 1, wherein the tubular contact includes a center contact and an outer contact which are fixed in a concentric manner in an inner region of the insulating housing, the center contact and the outer contact each including respective mating contacts to connect to the another connector with solder terminals extending radially outward from the mating contacts, and wherein the solder terminals of the center contact extend in radially opposite directions from the mating contact serving as a center, and extending distal ends of the solder terminals are bent upwards generally at right angles to stand up along an outer circumferential wall of the insulating housing, and are bent generally at right angles at standing upper ends and protruding radially outward generally horizontally so that outer end portions in a radial direction of the solder terminals of the center contact are set from above on connection terminals on the printed wiring board and joined thereto by soldering.

6. The coaxial electrical connector according to claim 1, wherein the tubular contact includes a center contact and an outer contact which are fixed in a concentric manner in an inner region of the insulating housing, the center contact and the outer contact each including respective mating contacts to connect to the another connector with solder terminals extending radially outward from the mating contacts, wherein the solder terminals of the center contact extend in radially opposite directions from the mating contact serving as a center, and extending distal ends of the solder terminals are bent upwards generally at right angles to stand up along an outer circumferential wall of the insulating housing, and are bent generally at right angles at standing upper ends and protruding radially outward generally horizontally so that outer end portions in a radial direction of the solder terminals of the center contact are set from above on connection terminals on the printed wiring board and joined thereto by soldering, and wherein the solder terminals of the outer contact extend downward from a lower end edge of the mating contacts and turn immediately back upward, standing up and being exposed from an outer circumferential wall of the insulating housing to an outside, and are bent generally at right angles at standing upper ends to protrude radially outward generally horizontally so that outer end portions in the radial direction of the solder terminals of the outer contact are set from above on ground connection terminals on the printed wiring board and joined thereto by soldering.

7. The coaxial electrical connector according to claim 1, wherein the printed wiring board includes signal connection terminals and ground connection terminals, wherein the tubular contact includes a center contact and an outer contact which are fixed in a concentric manner in an inner region of the insulating housing, the center contact and the outer contact each including respective mating contacts to connect to the plug connector with solder terminals extending radially outward from the mating contacts, and wherein a first set of the solder terminals are joined to the signal connection terminals on the printed wiring board via soldering, and a second set of the solder terminals are joined to the ground connection terminals via solder.

8. A coaxial electrical connector assembly, comprising a printed wiring board, a receptacle connector mounted on the printed wiring board having a signal connection terminal and a ground connection terminal formed as conductive paths on the printed wiring board, and a plug connector as a coupling counterpart of the receptacle connector, and including a tubular contact attached to an insulating housing of the receptacle connector to contact a tubular contact provided in the plug connector for establishing electrical connection, wherein the insulating housing of the receptacle connector is shaped to be inserted into a connector mounting portion formed as a recess or a through hole in the printed wiring board, wherein the insulating housing of the receptacle connector includes a connector holding portion to be abutted on a surface of the printed wiring board when the insulating housing is inserted into the connector mounting portion, and wherein the connector holding portion protrudes from a body of the insulating housing in a flange shape.

9. The coaxial electrical connector assembly according to claim 8, wherein the tubular contact includes a center contact and an outer contact which are fixed in a concentric manner in an inner region of the insulating housing, the center contact and the outer contact each including respective mating contacts to connect to the plug connector with solder terminals extending radially outward from the mating contacts.

10. The coaxial electrical connector assembly according to claim 8, wherein the tubular contact includes a center contact and an outer contact which are fixed in a concentric manner in an inner region of the insulating housing, the center contact and the outer contact each including respective mating contacts to connect to the plug connector with solder terminals extending radially outward from the mating contacts, and wherein the solder terminals of the center contact extend in radially opposite directions from the mating contact serving as a center, and extending distal ends of the solder terminals are bent upwards generally at right angles to stand up along an outer circumferential wall of the insulating housing of the receptacle connector, and are bent generally at right angles at standing upper ends and protruding radially outward generally horizontally so that outer end portions in a radial direction of the solder terminals of the center contact are set from above on connection terminals on the printed wiring board and joined thereto by soldering.

11. The coaxial electrical connector assembly according to claim 8, wherein the tubular contact includes a center contact and an outer contact which are fixed in a concentric manner in an inner region of the insulating housing, the center contact and the outer contact each including respective mating contacts to connect to the plug connector with solder terminals extending radially outward from the mating contacts, wherein the solder terminals of the center contact extend in radially opposite directions from the mating contact serving as a center, and extending distal ends of the solder terminals are bent upwards generally at right angles to stand up along an outer circumferential wall of the insulating housing of the receptacle connector, and are bent generally at right angles at standing upper ends and protruding radially outward generally horizontally so that outer end portions in a radial direction of the solder terminals of the center contact are set from above on connection terminals on the printed wiring board and joined thereto by soldering, and wherein the solder terminals of the outer contact extend downward from a lower end edge of the mating contacts and turn immediately back upward, standing up and being exposed from an outer circumferential wall of the insulating housing of the receptacle connector to an outside, and are bent generally at right angles at standing upper ends to protrude radially outward generally horizontally so that outer end portions in the radial direction of the solder terminals of the outer contact are set from above on ground connection terminals on the printed wiring board and joined thereto by soldering.

12. The coaxial electrical connector assembly according to claim 8, wherein the printed wiring board includes signal connection terminals and ground connection terminals, wherein the tubular contact includes a center contact and an outer contact which are fixed in a concentric manner in an inner region of the insulating housing of the receptacle connector, the center contact and the outer contact each including respective mating contacts to connect to the plug connector with solder terminals extending radially outward from the mating contacts, and wherein a first set of the solder terminals are joined to the signal connection terminals on the printed wiring board via soldering, and a second set of the solder terminals are joined to the ground connection terminals via solder.

* * * * *